US010119695B1

(12) United States Patent
Hsu

(10) Patent No.: US 10,119,695 B1
(45) Date of Patent: Nov. 6, 2018

(54) LED LAMP

(71) Applicant: Dong Guan Jia Sheng Lighting Technology Co., Ltd., Dong-Guna, Guang-Dong (CN)

(72) Inventor: Kevin Hsu, Taichung (TW)

(73) Assignee: Dong Guan Jia Sheng Lighting Technology Co., Ltd. China, Dong-Guna (CN)

( * ) Notice: Subject to any disclaimer, the term of this patent is extended or adjusted under 35 U.S.C. 154(b) by 0 days.

(21) Appl. No.: 15/695,064

(22) Filed: Sep. 5, 2017

(51) Int. Cl.

| | |
|---|---|
| ***F21V 25/12*** | (2006.01) |
| ***F21V 15/01*** | (2006.01) |
| *F21Y 103/20* | (2016.01) |
| *F21Y 115/10* | (2016.01) |

(52) U.S. Cl.
CPC ..... *F21V 25/12* (2013.01); *F21V 15/01* (2013.01); *F21Y 2103/20* (2016.08); *F21Y 2115/10* (2016.08)

(58) Field of Classification Search
CPC ..... F21V 25/12; F21V 15/01; F21Y 2115/10
See application file for complete search history.

(56) References Cited

U.S. PATENT DOCUMENTS 4,112,485 A * 9/1978 Sutter ..... F21L 4/00 362/369

* cited by examiner

*Primary Examiner* — Suezu Ellis
(74) *Attorney, Agent, or Firm* — Alan D. Kamrath; Kamrath IP Lawfirm, P.A.

(57) ABSTRACT

An LED filament module includes an LED filament and a fireproof tube mounted on an outer surface of the LED filament. The fireproof tube includes a main body having a tubular shape and a gum layer mounted on an outer surface of the main body. The main body is made of alkali-free glass fibers weaving together. The gum layer is made of an organic silicone that is treated by vulcanization.

10 Claims, 15 Drawing Sheets

LED LAMP

BACKGROUND OF THE INVENTION

1. Field of the Invention

The present invention relates to a lighting device and, more particularly, to an LED (light emitting diode) lamp.

2. Description of the Related Art

The LED is a new type of semiconductor solid light source, which has high safety and reliability, has low power consumption, has high luminous efficiency, has strong applicability, has good stability, has short response time, has changeable colors, and has environmental protection advantages. A conventional LED atmosphere light is used to present the effect of a real flame so as to enhance the amusement effect. However, the rays emitted from the conventional LED atmosphere light is not real enough, thereby limiting the flame simulation effect thereof. In addition, the LED soldering points of the conventional LED atmosphere light produce shadows so that the emitted rays are not soft, thereby decreasing the aesthetic quality of the conventional LED atmosphere light.

BRIEF SUMMARY OF THE INVENTION

The primary objective of the present invention is to provide an LED filament module that emits a light simulating and presenting the state of a real flame.

In accordance with the present invention, there is provided an LED filament module comprising an LED filament and a fireproof tube mounted on an outer surface of the LED filament. The fireproof tube includes a main body having a tubular shape and a gum layer mounted on an outer surface of the main body. The main body is made of alkali-free glass fibers weaving together. The gum layer is made of an organic silicone that is treated by vulcanization.

Preferably, the LED filament has a color temperature of about 2700K.

In accordance with the present invention, there is further provided an LED lamp comprising a base, at least one LED filament module mounted on the base, and a bulb mounted on the base. The bulb and the base form a closed cavity. The base is provided with a support extending toward the closed cavity. The at least one LED filament module is mounted on the support. The at least one LED filament module includes an LED filament and a fireproof tube mounted on an outer surface of the LED filament. The fireproof tube includes a main body having a tubular shape and a gum layer mounted on an outer surface of the main body. The main body is made of alkali-free glass fibers weaving together. The gum layer is made of an organic silicone that is treated by vulcanization.

Preferably, the at least one LED filament module is provided with a first connecting end and a second connecting end. The support is provided with two electric wires connected respectively with the first connecting end and the second connecting end of the at least one LED filament module.

Preferably, the LED lamp further comprises an outer lampshade mounted on the base and surrounding the bulb.

In accordance with the present invention, there is further provided an LED lamp comprising a stand, a base, a mounting bracket, an outer lampshade, an inner lampshade, and at least one LED filament module. The base is mounted on the stand. The mounting bracket is mounted on the base.

The outer lampshade is mounted on the mounting bracket and surrounds the inner lampshade. The inner lampshade is mounted on the base and received in the outer lampshade. The inner lampshade and the base form a closed cavity. The base is provided with a pole extending into the closed cavity. The at least one LED filament module is mounted on the pole and received in the closed cavity. The at least one LED filament module includes an LED filament and a fireproof tube mounted on an outer surface of the LED filament. The fireproof tube includes a main body having a tubular shape and a gum layer mounted on an outer surface of the main body. The main body is made of alkali-free glass fibers weaving together. The gum layer is made of an organic silicone that is treated by vulcanization.

Preferably, the LED lamp further comprises a retaining rack mounted in the mounting bracket. The inner lampshade is locked in the retaining rack.

Preferably, the LED lamp further comprises a control switch mounted on the base to turn on/off the LED lamp.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
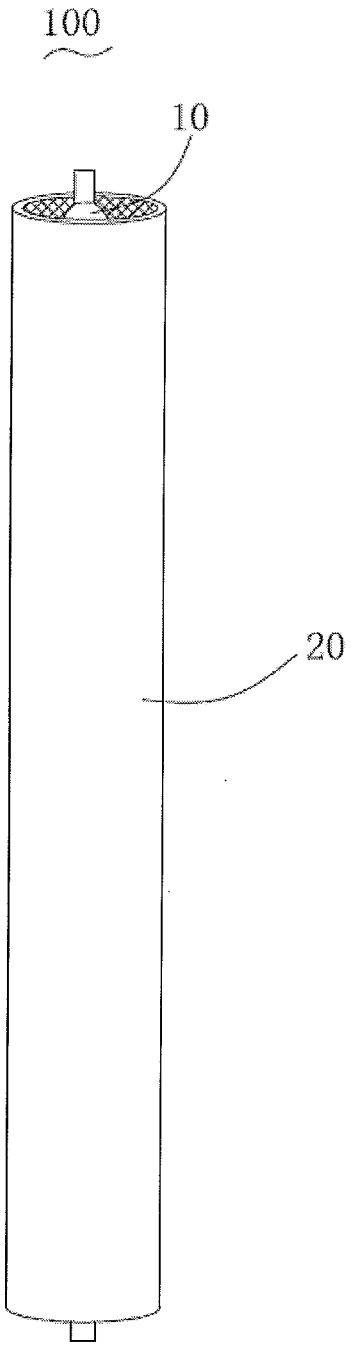
FIG. 1 is a perspective view of an LED filament module in accordance with the preferred embodiment of the present invention.
Figure 2:
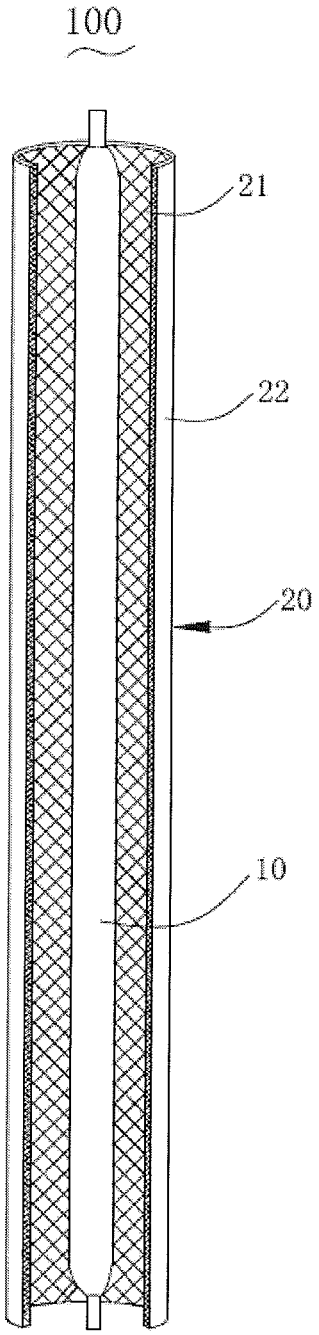
FIG. 2 is a cross-sectional view of the LED filament module as shown in FIG. 1.

Referring to the drawings and initially to FIGS. 1 and 2, an LED filament module 100 in accordance with the preferred embodiment of the present invention comprises an LED filament 10 and a fireproof tube 20 mounted on an outer surface of the LED filament 10. Thus, the LED filament module 100 emits a light that presents the state of a real flame.

The LED filament 10 has a color temperature of about 2700K. The fireproof tube 20 includes a main body 21 having a tubular shape and a gum layer 22 mounted on an outer surface of the main body 21. The main body 21 is made of alkali-free glass fibers weaving together. The alkali-free glass fibers are insulating, have a strong pull, will not be broken, are resistant to vulcanization and will not burn when touching the pure oxygen, so that the fireproof tube 20 have great flexibility and elasticity. The gum layer 22 is made of an organic silicone. Preferably, the organic silicone is treated by vulcanization. After the fireproof tube 20 is processed by vulcanization, the fireproof tube 20 functions and maintains its flexibility and elasticity during a long-term utilization at the temperature ranged between −65° C. and 260° C. Thus, the fireproof tube 20 protects the LED filament 10 efficiently when the LED filament module 100 is hit by an external force. In addition, the fireproof tube 20 is resistant to a high temperature and a fire, is electrically insulating and has a safely environmental feature.

The fireproof tube 20 is opaque but light permeable so that LED soldering points of the LED filament 10 do not produce shadow, and the LED filament module 100 emits the light more evenly. The fireproof tube 20 reduces the color temperature of the LED filament 10 from 2700K to 2200K, so that the light emitted by the LED filament module 100 is softer, and the color temperature of the LED filament 10 is like the real flame.

Figure 3:
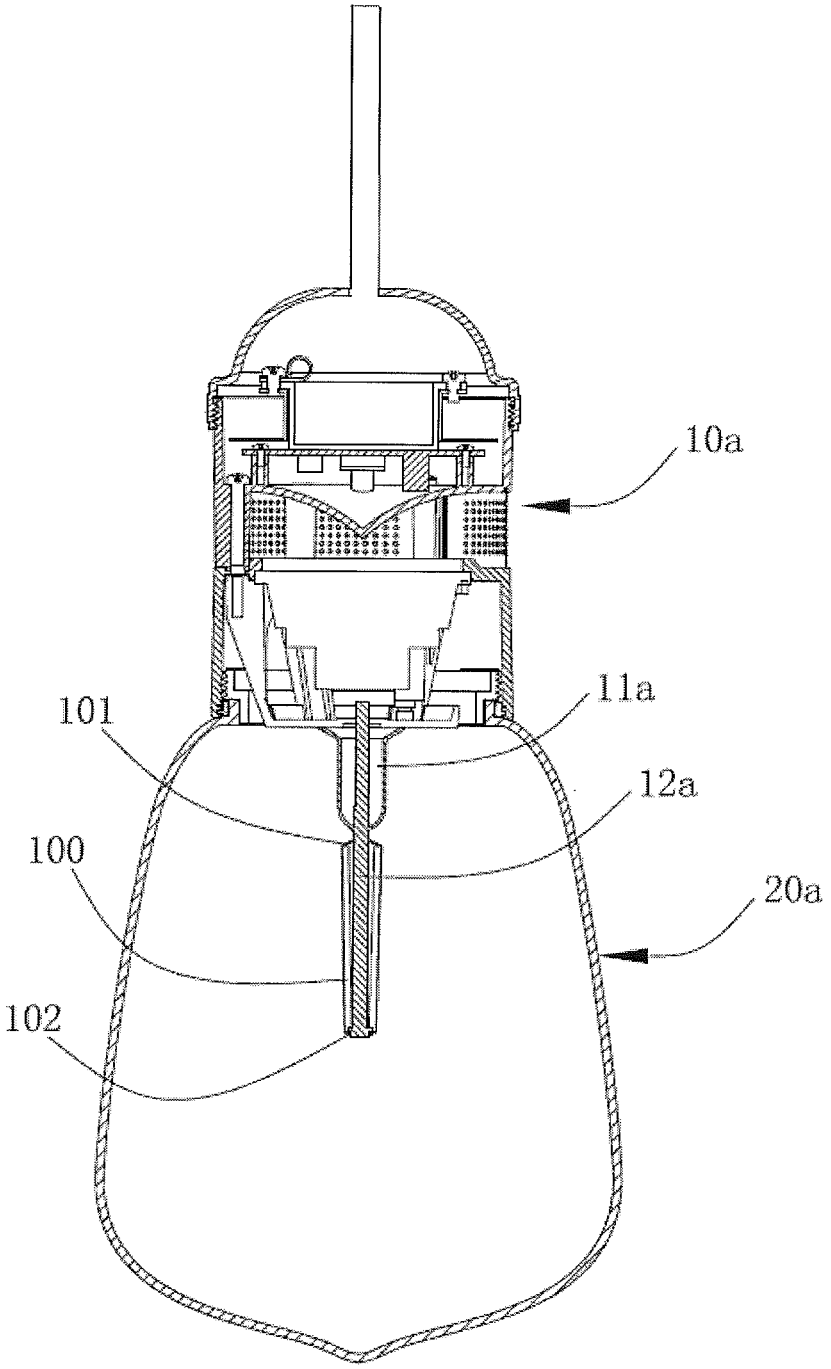
FIG. 3 is a cross-sectional view of an LED lamp in accordance with the first preferred embodiment of the present invention.

Referring to FIG. 3, an LED lamp in accordance with the preferred embodiment of the present invention comprises a base 10*a*, at least one LED filament module 100 mounted on the base 10*a*, and a bulb 20*a* mounted on the base 10*a*. The bulb 20*a* and the base 10*a* form a closed cavity. The base 10*a* is provided with a support 11*a* extending toward the closed cavity. The support 11*a* is provided with a pole 12*a* extending outward therefrom. The at least one LED filament module 100 is mounted on the pole 12*a*.

The at least one LED filament module 100 is provided with a first connecting end 101 and a second connecting end 102. The support 11*a* has an end provided with two electric wires (not shown) located adjacent to the pole 12*a*. The first connecting end 101 of the at least one LED filament module 100 is connected with the two electric wires of the support 11*a*, and the second connecting end 102 of the at least one LED filament module 100 is secured on an end of the pole 12*a* and is spaced from the support 11*a*. Preferably, the LED lamp comprises four LED filament modules 100. In addition, the LED lamp further comprises a control switch (not shown) mounted on the base 10*a* to turn on/off the LED lamp.

Figure 4:
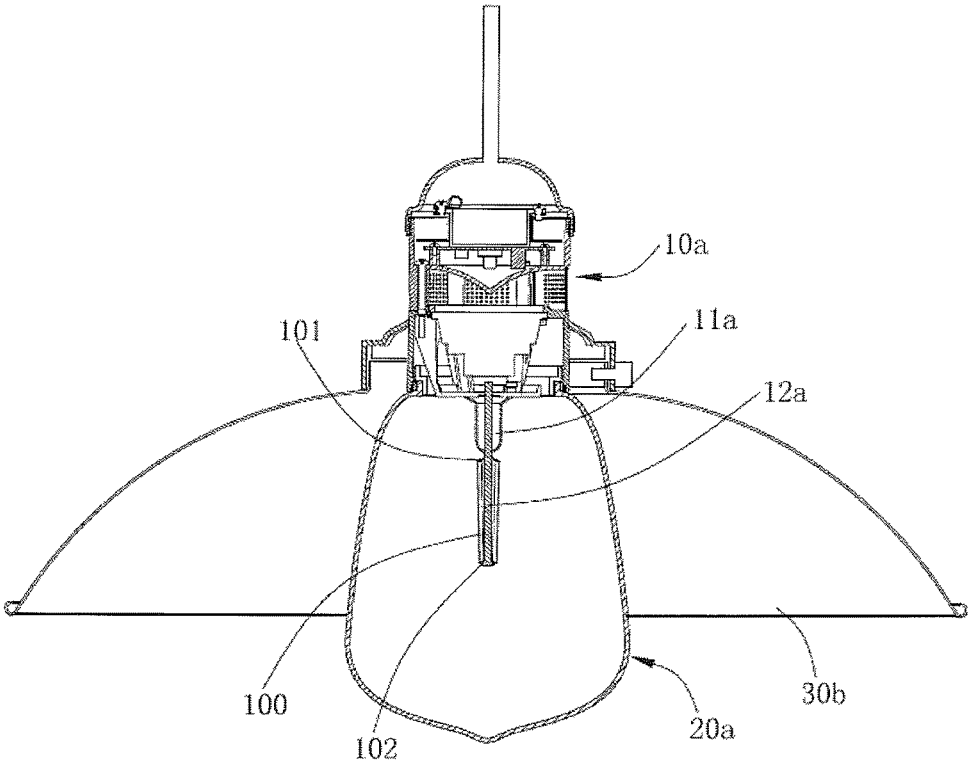
FIG. 4 is a cross-sectional view of an LED lamp in accordance with the second preferred embodiment of the present invention.

Referring to FIG. 4, the LED lamp further comprises an outer lampshade 30*b* mounted on the base 10*a* and surrounding the bulb 20*a*.

Figure 5:
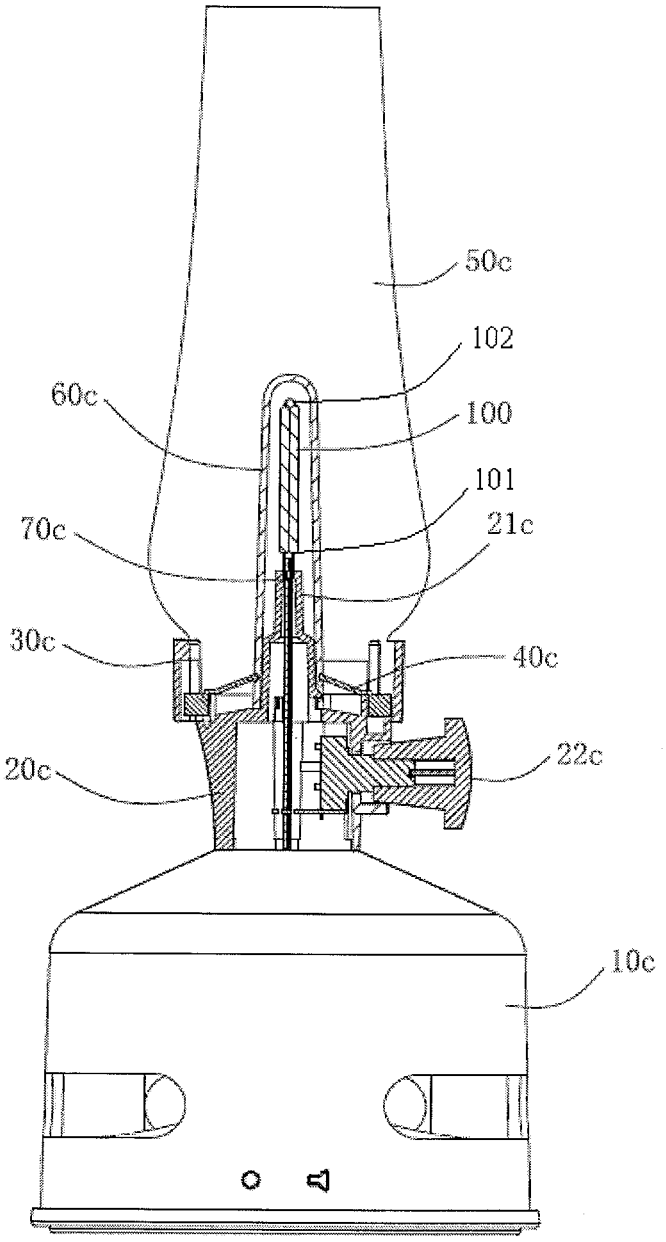
FIG. 5 is a cross-sectional view of an LED lamp in accordance with the third preferred embodiment of the present invention.

Referring to FIG. 5, an LED lamp in accordance with the preferred embodiment of the present invention functions as an oil lamp and comprises a stand 10*c*, a base 20*c*, a mounting bracket 30*c*, a retaining rack 40*c*, an outer lampshade 50*c*, an inner lampshade 60*c*, and at least one LED filament module 100. The base 20*c* is mounted on the stand 10*c*. The mounting bracket 30*c* is mounted on the base 20*c*. The retaining rack 40*c* is mounted in the mounting bracket 30*c*. The inner lampshade 60*c* is mounted on the base 20*c* and locked in the retaining rack 40*c*. The inner lampshade 60*c* and the base 20*c* form a closed cavity. The base 20*c* is provided with a pole 21*c* extending into the closed cavity. The at least one LED filament module 100 is mounted on the pole 21*c* and received in the closed cavity. The outer lampshade 50*c* is mounted on the mounting bracket 30*c* and surrounds the inner lampshade 60*c*.

The at least one LED filament module 100 is provided with a first connecting end 101 and a second connecting end 102. The pole 21*c* has an upper end provided with two electric wires 70*c*. In the preferred embodiment of the present invention, the LED lamp comprises an LED filament module 100. At this time, one of the two electric wires 70*c* is connected with the first connecting end 101 of the LED filament module 100, and the other one of the two electric wires 70*c* is connected with the second connecting end 102 of the LED filament module 100. Alternatively, the LED lamp comprises more than two LED filament modules 100. At this time, each of the two electric wires 70*c* is connected with the first connecting end 101 of each of the LED filament modules 100, and the second connecting end 102 of each of the LED filament modules 100 is secured on a distal end of the pole 21*c*. The LED lamp further comprises a control switch 22*c* mounted on the base 20*c* to turn on/off the LED lamp.

In conclusion, the fireproof tube 20 is arranged outside of the LED filament 10. The fireproof tube 20 is made of material resistant to a high temperature and has great flexibility and elasticity, so that the fireproof tube 20 protects the LED filament 10 efficiently, to prevent the LED filament 10 from being broken. In addition, the fireproof tube 20 is opaque but light permeable so that the shadow of the LED soldering points of the LED filament 10 will not be seen easily. Further, the fireproof tube 20 is made of paper, gauze, cotton, weaving material or plastic material, to change the color temperature of the LED filament 10, so that the fireproof tube 20 reduces the color temperature of the LED filament 10 from 3000K to 2700K, or from 2700K to 2200K. Further, the fireproof tube 20 reduces the color temperature of the LED filament 10 from 2700K to 2200K, so that the light emitted by the LED filament module 100 is softer, and the color temperature of the LED filament 10 is like the real flame. Further, the LED filament module 100 is available for various mobile and fixed lamps, including a pendent lamp, a table lamp, a wall lamp, an LED oil lamp with a sounding effect, a recessed light or a ceiling fitting.

Figure 6:
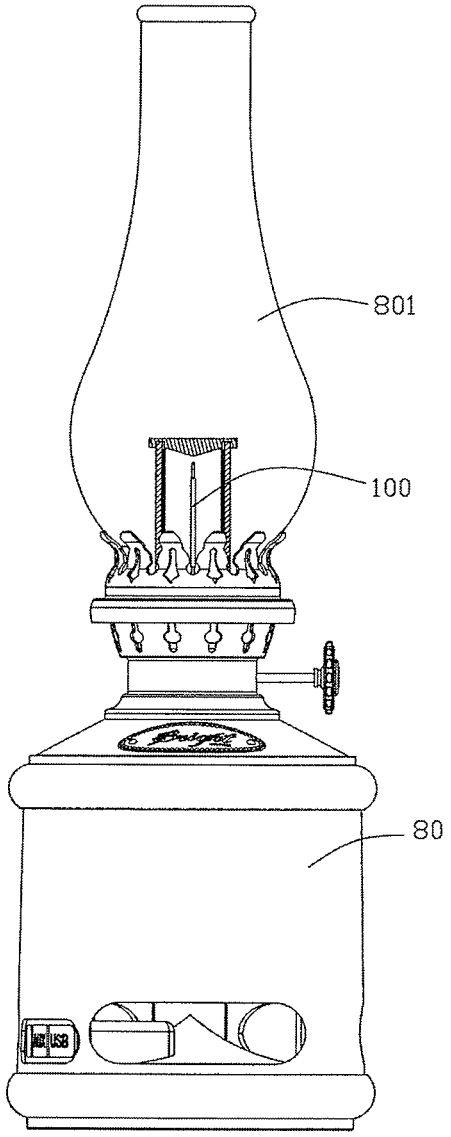
FIG. 6 is a partially cross-sectional view of the LED filament module for a revival oil lamp with a sounding effect in accordance with the present invention.

Referring to FIG. 6, the LED filament module 100 is mounted in a lampshade 801 of a revival oil lamp 80 with a sounding effect.

Figure 7:
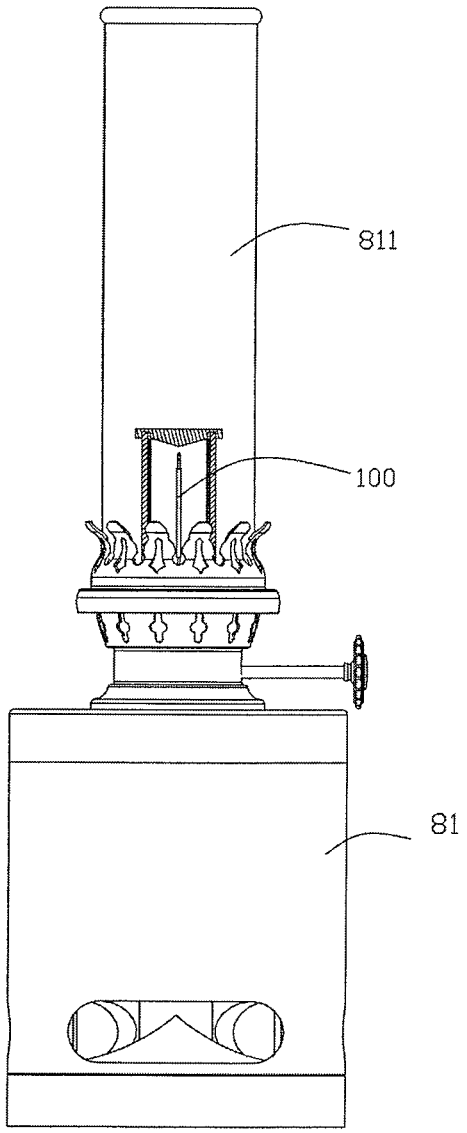
FIG. 7 is a partially cross-sectional view of the LED filament module for another revival oil lamp with a sounding effect in accordance with the present invention.

Referring to FIG. 7, the LED filament module 100 is mounted in a lampshade 811 of another revival oil lamp 81 with a sounding effect.

Figure 8:
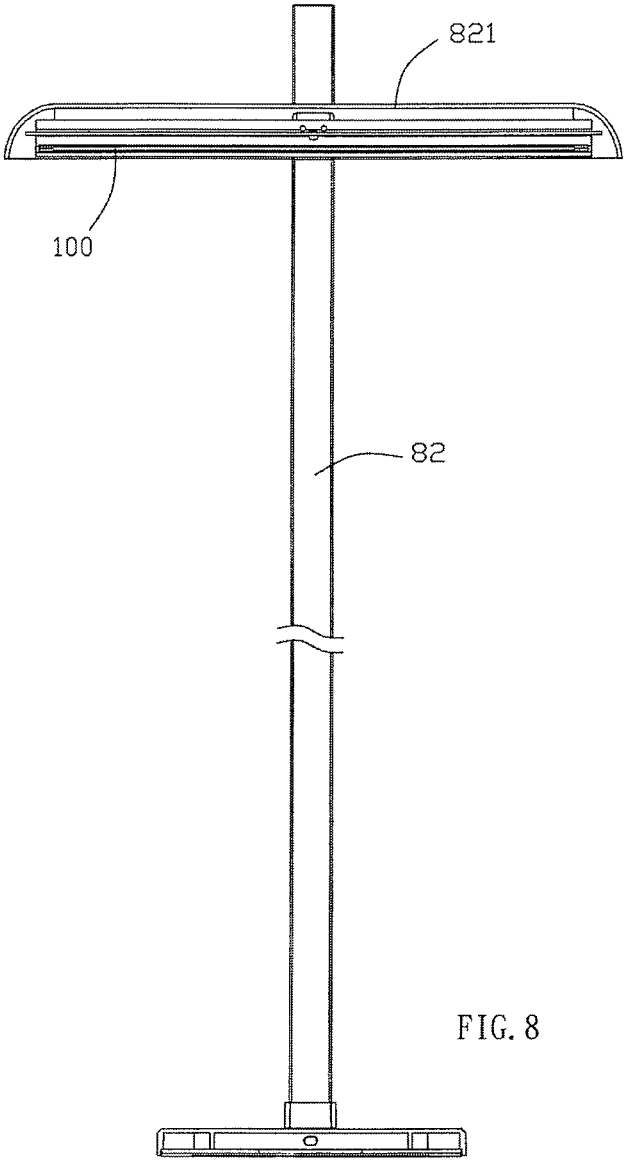
FIG. 8 is a partially cross-sectional view of the LED filament module for a floor lamp in accordance with the present invention.

Referring to FIG. 8, the LED filament module 100 is mounted in a lampshade 821 of a floor lamp 82.

Figure 9:
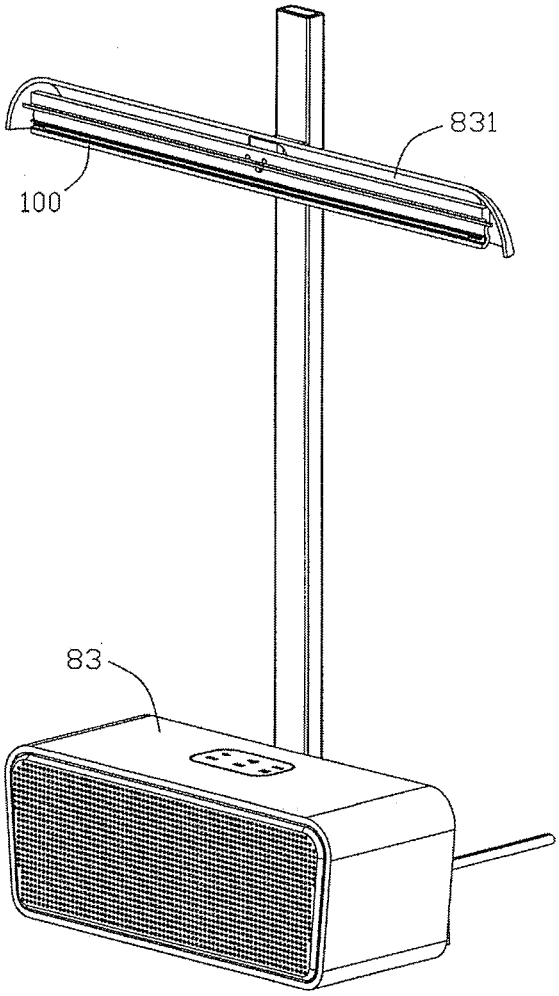
FIG. 9 is a perspective view of the LED filament module for a bank table lamp with a sounding effect in accordance with the present invention.

Referring to FIG. 9, the LED filament module 100 is mounted in a lampshade 831 of a bank table lamp 83 with a sounding effect.

Figure 10:
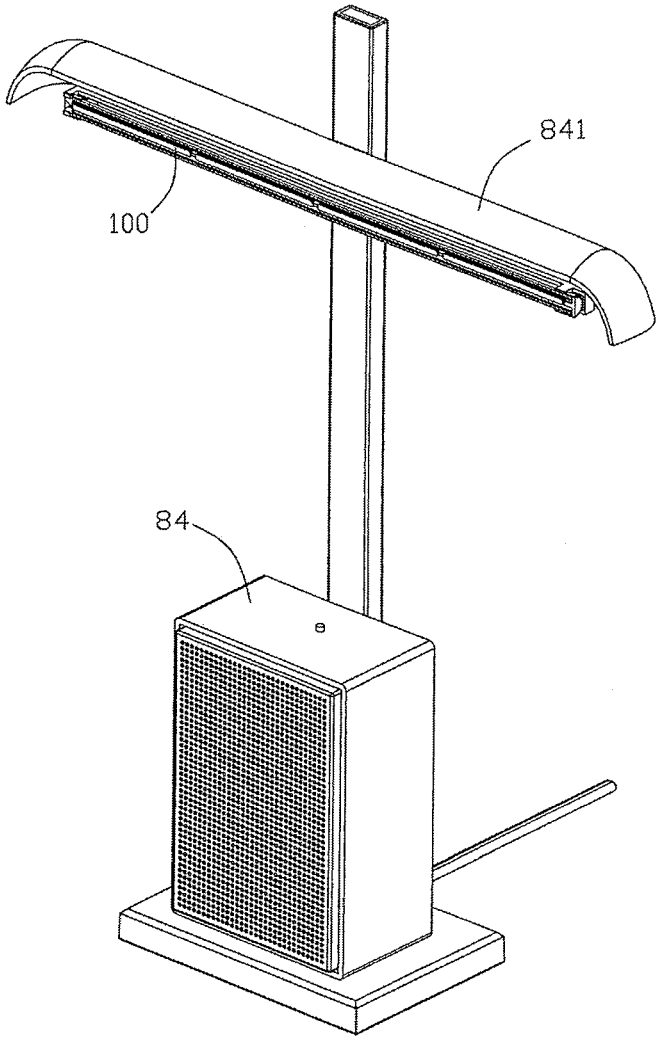
FIG. 10 is a perspective view of the LED filament module for another bank table lamp with a sounding effect in accordance with the present invention.

Referring to FIG. 10, the LED filament module 100 is mounted in a lampshade 841 of another bank table lamp 84 with a sounding effect.

Figure 11:
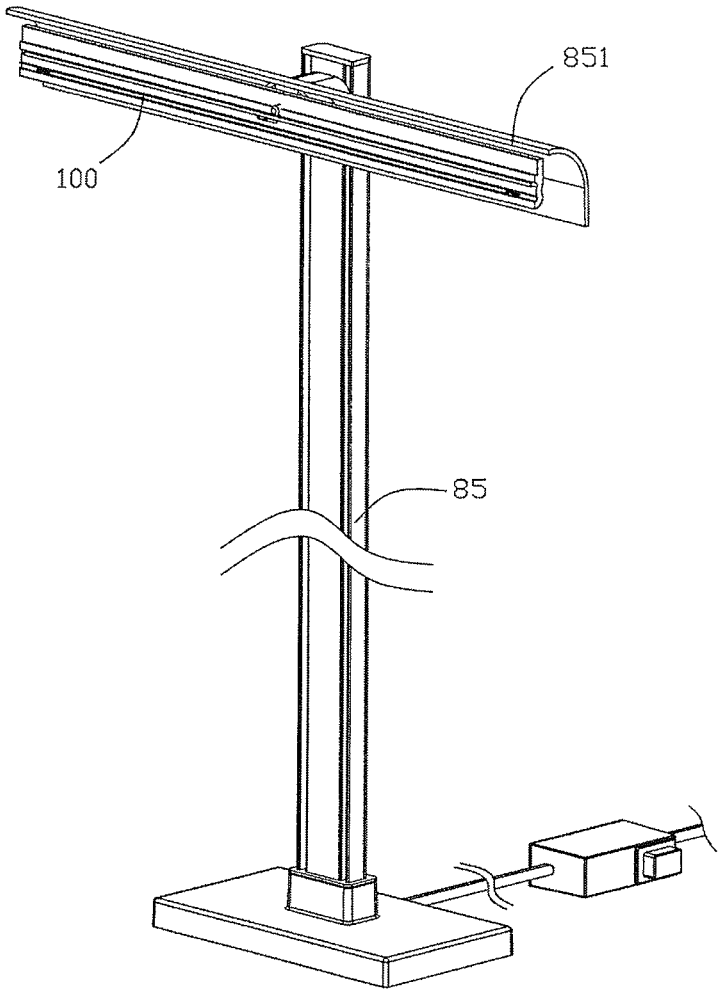
FIG. 11 is a perspective view of the LED filament module for a bank table lamp in accordance with the present invention.

Referring to FIG. 11, the LED filament module 100 is mounted in a lampshade 851 of a bank table lamp 85.

Figure 12:
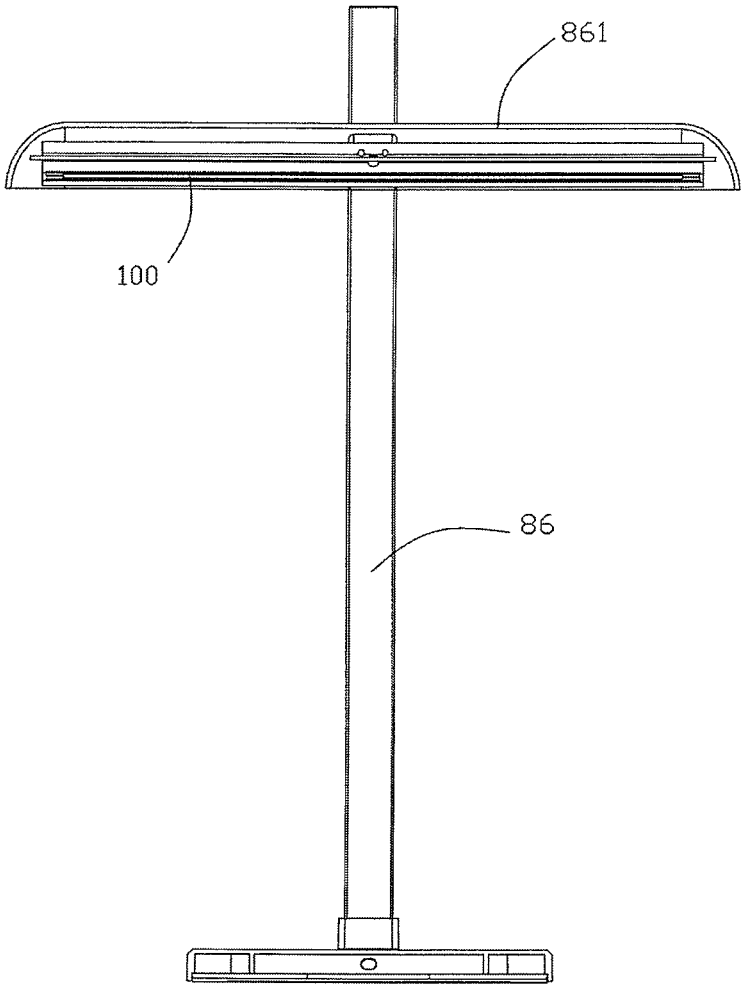
FIG. 12 is a perspective view of the LED filament module for another bank table lamp in accordance with the present invention.

Referring to FIG. 12, the LED filament module 100 is mounted in a lampshade 861 of another bank table lamp 86.

Figure 13:
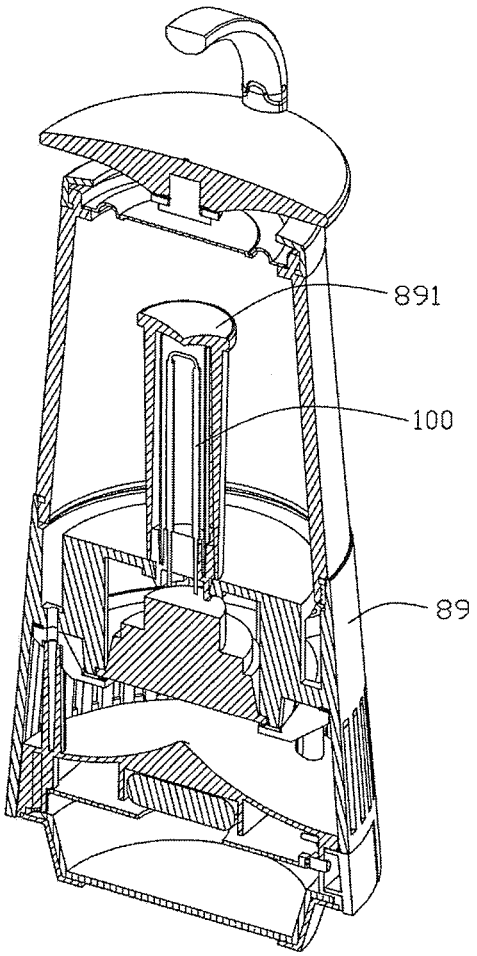
FIG. 13 is a perspective cross-sectional view of the LED filament module for a mobile table lamp with a sounding effect in accordance with the present invention.

Referring to FIG. 13, the LED filament module 100 is mounted in a lampshade 891 of a mobile table lamp 89 with a sounding effect.

Figure 14:
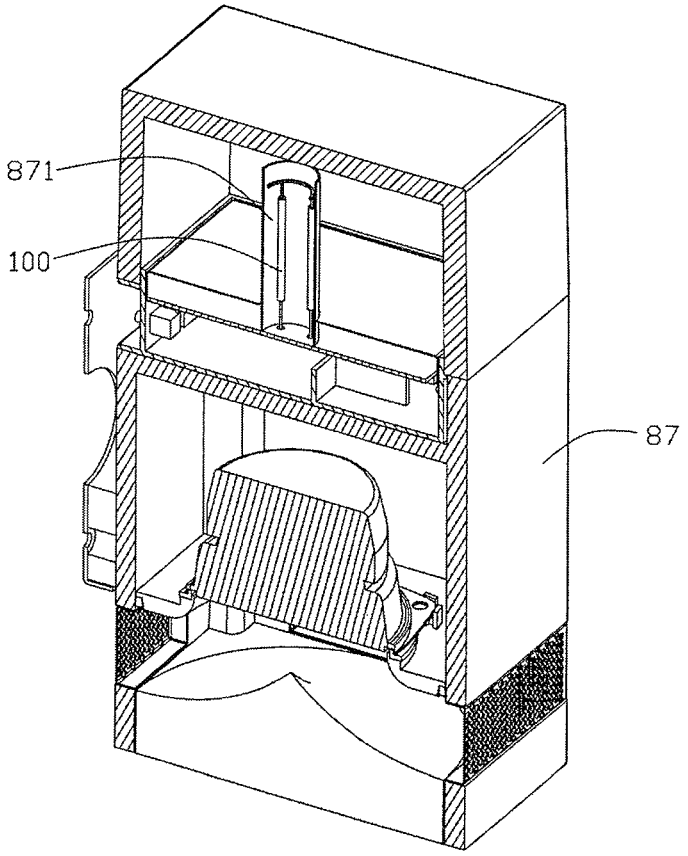
FIG. 14 is a perspective cross-sectional view of the LED filament module for a table lamp with a sounding effect in accordance with the present invention.

Referring to FIG. 14, the LED filament module 100 is mounted in a lampshade 871 of a table lamp 87 with a sounding effect.

Figure 15:
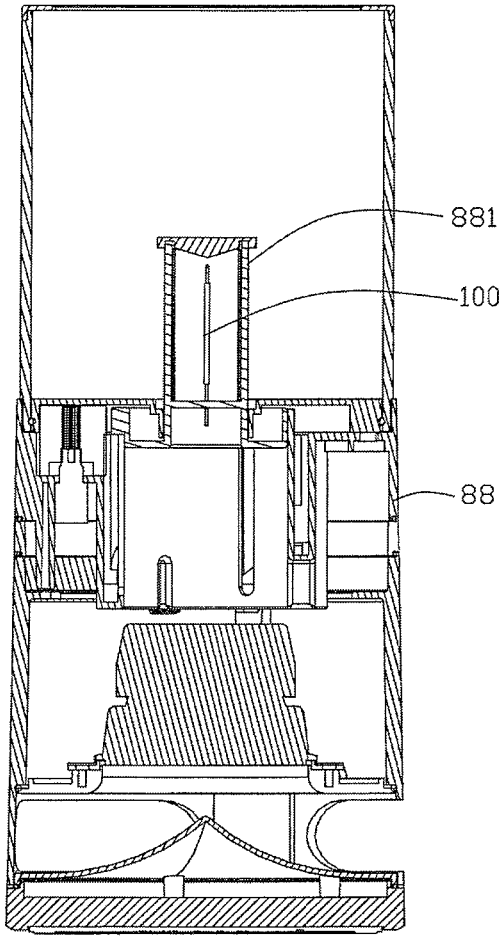
FIG. 15 is a perspective cross-sectional view of the LED filament module for another mobile table lamp with a sounding effect in accordance with the present invention.

Referring to FIG. 15, the LED filament module 100 is mounted in a lampshade 881 of another mobile table lamp 88 with a sounding effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An LED filament module comprising:

an LED filament; and a fireproof tube mounted on an outer surface of the LED filament;

wherein:

the fireproof tube includes a main body having a tubular shape and a gum layer mounted on an outer surface of the main body;

the main body is made of alkali-free glass fibers weaving together; and the gum layer is made of an organic silicone that is treated by vulcanization.

2. The LED filament module of claim 1, wherein the LED filament has a color temperature of about 2700K.

3. An LED lamp comprising:

a base;

at least one LED filament module mounted on the base; and a bulb mounted on the base;

wherein:

the bulb and the base form a closed cavity;

the base is provided with a support extending toward the closed cavity;

the at least one LED filament module is mounted on the support;

the at least one LED filament module includes an LED filament and a fireproof tube mounted on an outer surface of the LED filament;

the fireproof tube includes a main body having a tubular shape and a gum layer mounted on an outer surface of the main body;

the main body is made of alkali-free glass fibers weaving together; and the gum layer is made of an organic silicone that is treated by vulcanization.

4. The LED lamp of claim 3, wherein the at least one LED filament module is provided with a first connecting end and a second connecting end, the support is provided with two electric wires connected respectively with the first connecting end and the second connecting end of the at least one LED filament module.

5. The LED lamp of claim 4, further comprising:

an outer lampshade mounted on the base and surrounding the bulb.

6. The LED lamp of claim 3, wherein the LED filament has a color temperature of about 2700K.

7. An LED lamp comprising:

a stand, a base, a mounting bracket, an outer lampshade, an inner lampshade, and at least one LED filament module;

wherein:

the base is mounted on the stand;

the mounting bracket is mounted on the base;

the outer lampshade is mounted on the mounting bracket and surrounds the inner lampshade;

the inner lampshade is mounted on the base and received in the outer lampshade;

the inner lampshade and the base form a closed cavity;

the base is provided with a pole extending into the closed cavity;

the at least one LED filament module is mounted on the pole and received in the closed cavity;

the at least one LED filament module includes an LED filament and a fireproof tube mounted on an outer surface of the LED filament;

the fireproof tube includes a main body having a tubular shape and a gum layer mounted on an outer surface of the main body;

the main body is made of alkali-free glass fibers weaving together; and the gum layer is made of an organic silicone that is treated by vulcanization.

8. The LED lamp of claim 7, further comprising:

a retaining rack mounted in the mounting bracket;

wherein:

the inner lampshade is locked in the retaining rack.

9. The LED lamp of claim 7, further comprising:

a control switch mounted on the base to turn on/off the LED lamp.

10. The LED lamp of claim 7, wherein the LED filament has a color temperature of about 2700K.

* * * * *